US005384970A

United States Patent [19]

Melton

[11] Patent Number: 5,384,970

[45] Date of Patent: Jan. 31, 1995

[54] ADJUSTABLE FIT FOOTWEAR

[75] Inventor: Florence Melton, Columbus, Ohio

[73] Assignee: R. G. Barry Corporation, Pickerington, Ohio

[21] Appl. No.: 127,486

[22] Filed: Sep. 28, 1993

Related U.S. Application Data

[63] Continuation-in-part of Ser. No. 780,922, Oct. 22, 1991, abandoned.

[51] Int. Cl.[6] ..... A43B 7/14; A43B 3/26; A43B 1/02

[52] U.S. Cl. ..... 36/88; 36/97; 36/45; 36/9 R

[58] Field of Search ..... 36/50.1, 89, 54, 45, 36/9 R, 97, 88, 138, 112; 2/DIG. 6

[56] References Cited

U.S. PATENT DOCUMENTS

| | | | |
|---|---|---|---|
| 1,291,958 | 1/1919 | Lund | 36/9 R |
| 2,193,943 | 3/1940 | Shea | 36/11.5 |
| 2,513,005 | 6/1950 | Crawford | 36/11.5 |
| 2,799,951 | 7/1957 | Rogers | 36/9 R X |
| 3,618,235 | 11/1971 | Cary, Jr. | 36/54 X |
| 3,735,758 | 5/1973 | Novotney | 36/50.1 X |
| 4,370,818 | 2/1983 | Simoglov | 36/54 X |
| 4,377,913 | 3/1983 | Stone | 36/54 X |
| 4,463,761 | 8/1984 | Pols et al. | 36/88 X |
| 4,599,811 | 7/1586 | Rousseau | 36/97 X |
| 4,724,623 | 2/1988 | Silverman | 36/54 X |
| 4,733,170 | 9/1988 | Moore et al. | 36/110 |
| 4,969,277 | 11/1990 | Williams | 36/50.1 X |
| 4,972,610 | 11/1990 | Tong | 36/115 X |

FOREIGN PATENT DOCUMENTS

| | | | |
|---|---|---|---|
| 2499375 | 8/1982 | France | 36/54 |
| 2541566 | 8/1984 | France | 36/54 |
| 2048646 | 12/1980 | United Kingdom | 36/50.1 |

OTHER PUBLICATIONS

P. 3 of a catalog of Dr. Leonard's Health Care Products shows a "comfort shoe" having a front flap.

*Primary Examiner*—Paul T. Sewell
*Assistant Examiner*—Beth Anne C. Cicconi
*Attorney, Agent, or Firm*—Watson, Cole, Grindle & Watson

[57] ABSTRACT

An article of footwear including a sole extending from a toe to a heel. An upper is secured to the sole. The upper is formed of flexible material shaped to conform to a foot. The upper has opposing edges which define an ankle opening and a slot extending from the toe portion to the ankle opening. A flap is secured to the sole and sized to cover the slot. Adhering tabs are used to adhere the flap to the upper. The flap includes a raised end at the toe portion.

5 Claims, 11 Drawing Sheets

39
84
16
46
14
42
34
27
10'
10

ADJUSTABLE FIT FOOTWEAR

This application is a continuation-in-part of application Ser. No. 780,922, filed Oct. 22, 1991, now abandoned.

BACKGROUND OF THE INVENTION

1. Field of the Invention

This invention pertains to adjustable fit footwear. More particularly, this invention pertains to such footwear which has particularly suitable application for use as post-operative footwear.

2. Description of the Prior Art

Mass produced footwear is designed to be worn on feet of normal size and shape. For many individuals, such footwear either cannot be worn or, if worn, is extremely uncomfortable. For example, during post-operative recovery from foot surgery, a patient's foot may be extremely swollen or bandaged to such an extent that most available footwear cannot be worn comfortably. Slippers available for post-operative use commonly have an open toe portion which provides no protection or comfort from the effects of cold weather, rain and the like. The exposed area also presents possibilities for infection. Also, people with chronic edema or swelling from day-to-day require footware to accommodate the swelling. Also, deformities such as hammer-toe and the like require custom made footwear which is very expensive. Even when custom made footwear is available, it is not wholly satisfactory.

In the case of post-operative foot surgery, the amount of bandages may vary from time-to-time requiring adjustable footware.

Some standard footwear may provide additional width by loosening of ties, for example. However, this does not provide extra width or depth in the lower area of the foot where swelling and tenderness are often present either from swelling or from deformities of the feet or toes. Even larger sizes or larger widths of standard footwear do not fulfill the special needs of these people. Consequently, such people suffer from lack of wearable footwear and are often seen in tight and constricting shoes for want of acceptable and proper fitting footwear. Many such people are prevented from going outdoors or from moving about in pursuit of normal work at home because of the lack of properly fitted footwear.

It is an object of the present invention to provide footwear which is adjustable to permit variable widths and allow the wearer to adjust the footwear to accommodate extra widths as needed. Also, it is an object of the present invention to provide adjustable footwear which permits depth in the toe portion to accommodate a variety of problems in the toes or forepart of the foot.

SUMMARY OF THE INVENTION

According to a preferred embodiment of the present invention, an article of footwear is provided which includes a sole extending from a toe end to a heel end. An upper is secured to the sole. The upper is formed of a flexible material shaped to conform to a foot of a wearer. The upper has opposing edges which define an ankle opening as well as defining a slot extending from the toe portion to the ankle opening. A flap is secured to the sole and sized to cover the slot. The flap is releasably adherable to the upper. The flap includes a raised end at the toe portion of the sole.

DESCRIPTION OF THE PREFERRED EMBODIMENT

Referring now to the several drawing figures in which identical elements are numbered throughout, the structure and construction of an article of footwear made according to the present invention will now be described. In the present description, the article of footwear will be described as a slipper having a soft sole. It will be appreciated by those skilled in the art that the footwear could also be made with a firm outsole where required (for example, for use in outdoor wear).

Figure 1:
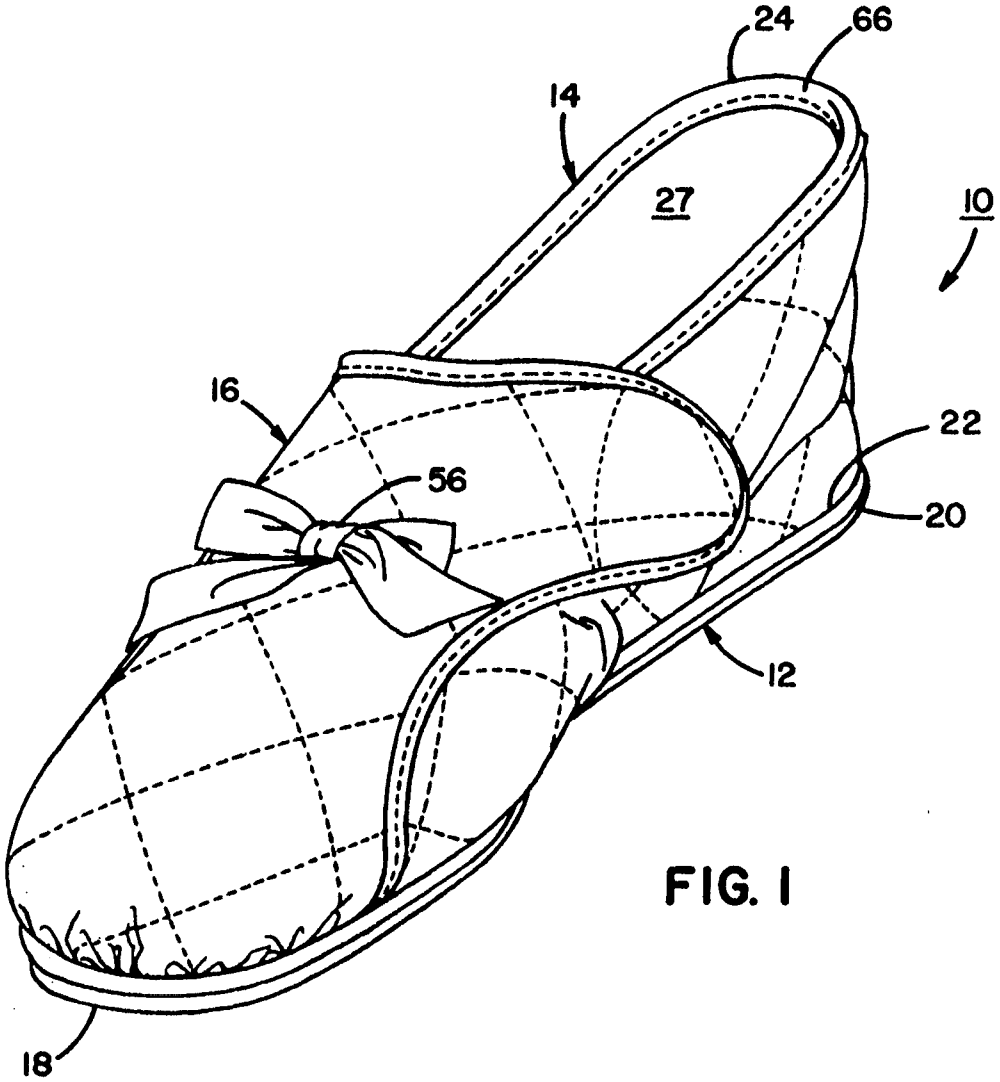
FIG. 1 is a front, top and left side perspective view of an article of footwear according to the present invention.
Figure 2:
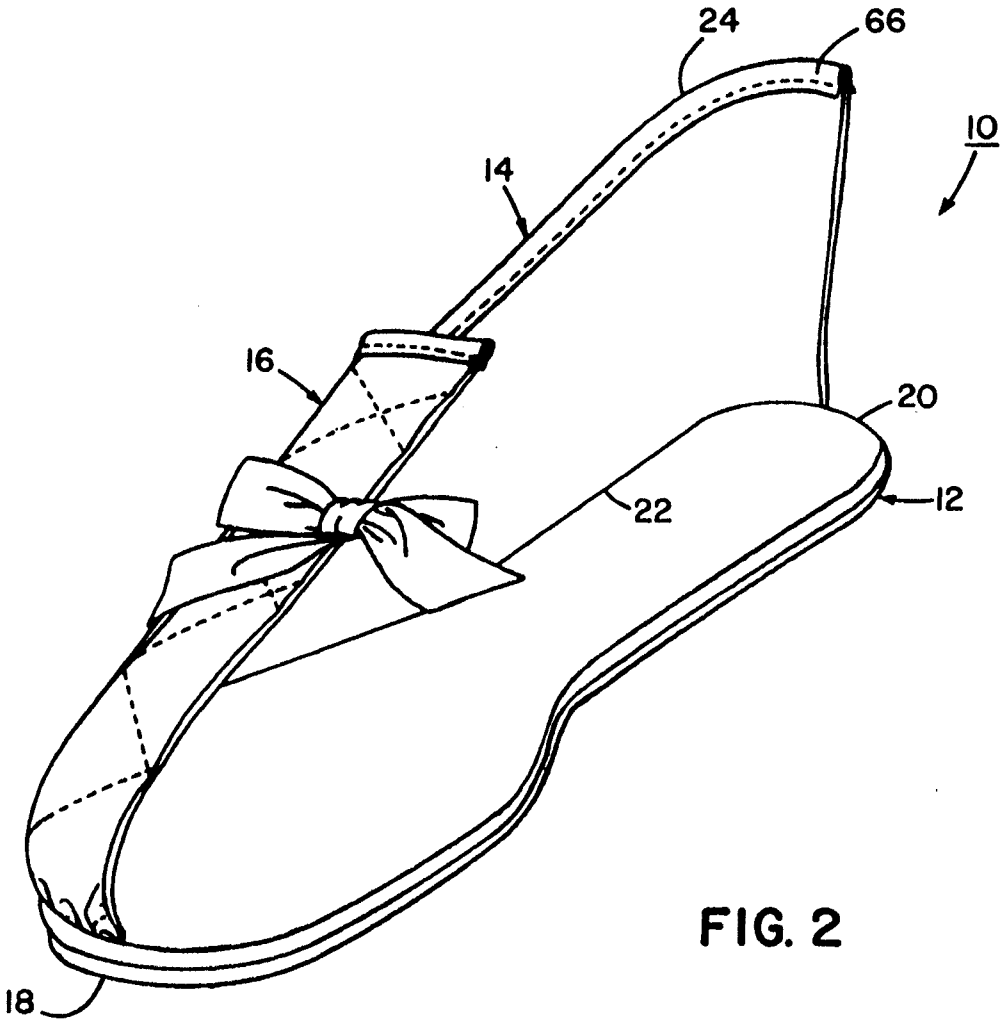
FIG. 2 is a cross-sectional view of the footwear of FIG. 1.

With initial reference to FIGS. 1 and 2, the footwear 10 includes a sole 12, an upper 14 and a flap 16. The sole 12 extends from a toe portion 18 to a heel portion 20. The upper 14 includes a lower edge 22 which is secured to the sole 12. An upper edge 24 of upper 14 defines an ankle opening 27 (see FIG. 1).

Figure 3:
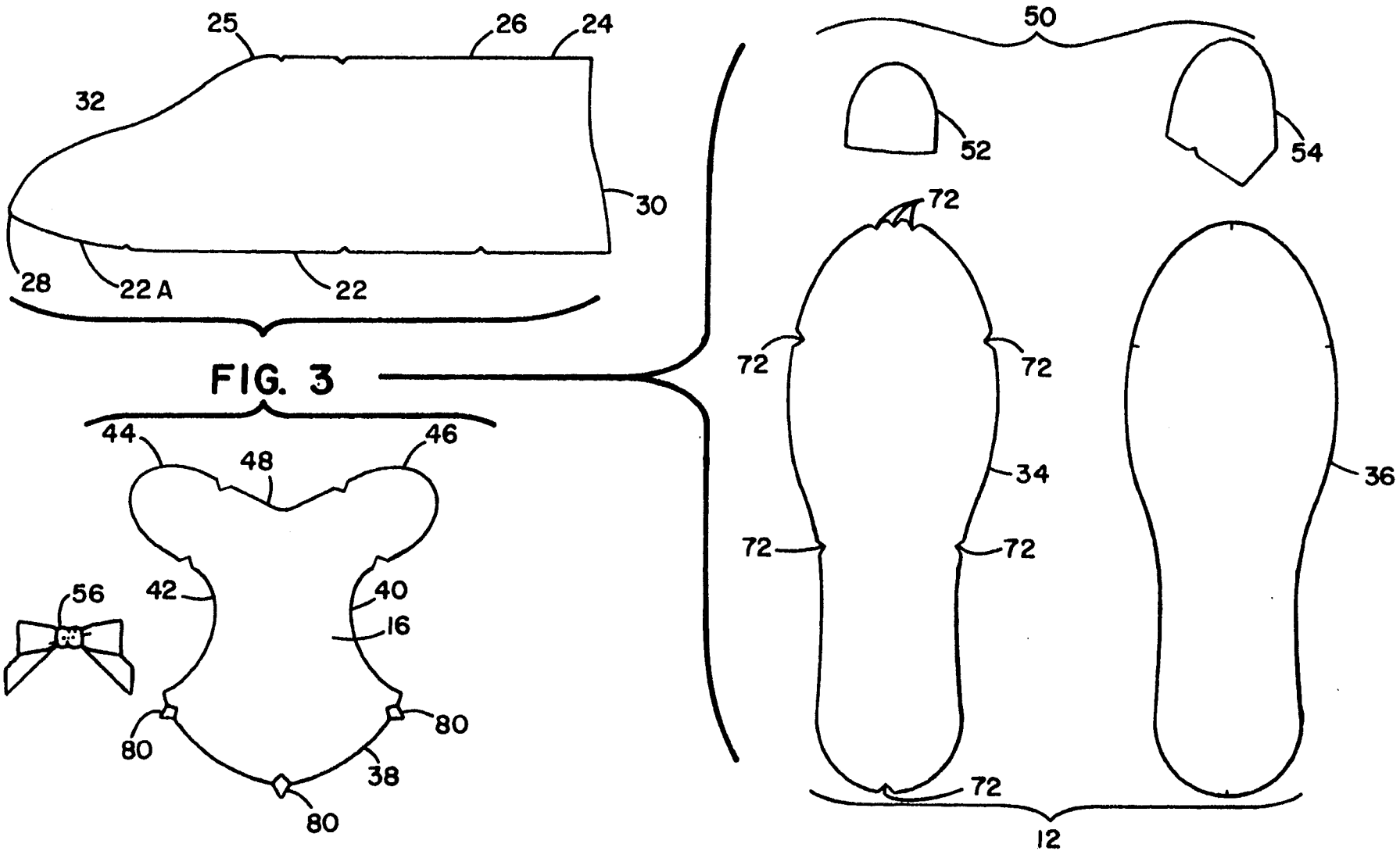
FIG. 3 is a view showing various components of the footwear of FIG. 1.

Before proceeding with a discussion of the completed structure of slipper 10, a description of its elements and its construction will assist in an appreciation of the present invention. The upper 14 is formed from two vamps 26 (only one of which is shown in FIG. 3, the other being identical). The lower edge 22 of each vamp is generally straight but includes an upwardly curved portion **22*a* near the toe end 28 of the vamp. It will be appreciated that the lower edges 22 of the vamps align and become the lower edge of the upper 14**.

The heel end 30 of the vamp 26 extends generally perpendicular to lower edge 22 and terminates at the upper edge 24 of the vamp 26. It will be appreciated that in final construction the upper edges 24 of the vamps 26 cooperate to define the upper edge of the slipper upper 14. The upper edge 24 extends from the heel end 30 in a line generally parallel to lower edge 22 and terminates at the end 25 of the desired ankle opening 27. Toe end 28 and forward end 25 are connected by the angularly upwardly projecting forward edge 32.

The sole 12 includes an insole 34 and an outsole 36. The insole 34 has alignment notches 72, the function of which will be described.

The flap 16 includes a convex arcuate toe edge 38, concave side edges 40,42 and outwardly projecting tab ends 44,46. An ankle opening edge 48 extends between the tab ends 44,46. Alignment tabs 80 are formed on edge 38.

Cooperative fastener means 50 is provided by pads 52,54 of a hook and loop-type fastener. A commonly available fastener of the hook and loop variety is sold under the trademark Velcro TM and includes a loop pad 52 and a hook pad 54. Two each of pads 52,54 are required for construction of the slipper 10. If desired, decoration in the form of a bow 56 may be added to the footwear 10.

For reasons that will become apparent, the vamps 26, flap 16 and insole 34 are all formed from washable material. Preferably, the vamp 26 and flap 16 are formed of identical fabric which is soft washable fabric backed by a soft cushioning such as foam or quilting to provide body to the upper 14 and to ensure constant cushion softness in the upper 14. The insole is made of washable fabric with a cushioned middle sole of foam. Preferably, the outsole 36 is formed of skid resistant materials such as synthetic plastic.

Figure 6:
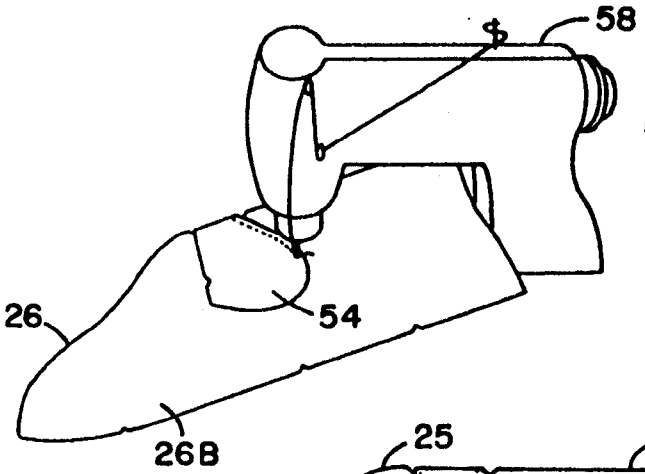
FIGS. 4–27 illustrate steps in the construction of the footwear of FIG. 1.
Figure 7:
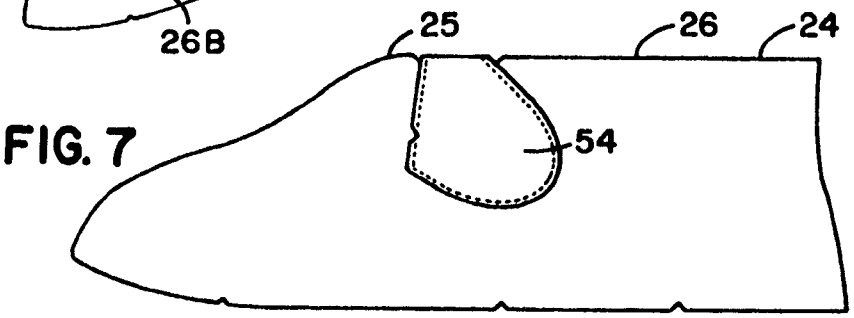
Figure 8:
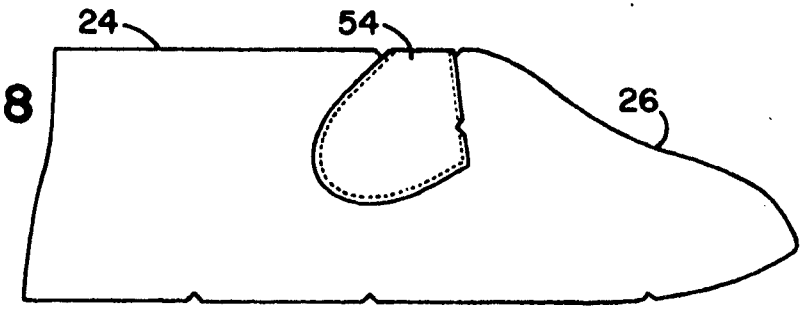
Figure 4:
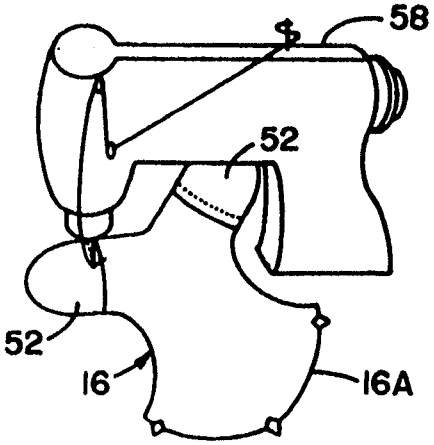
Figure 5:
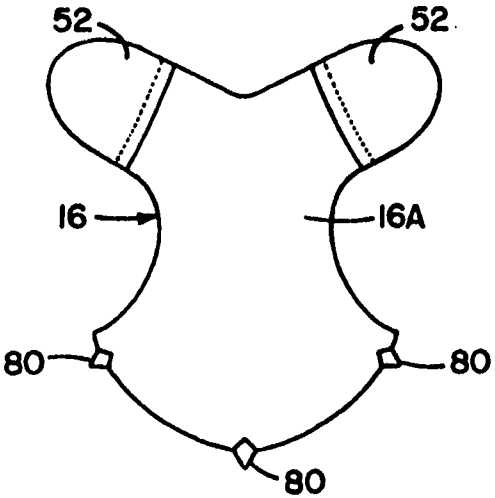
Figure 9:
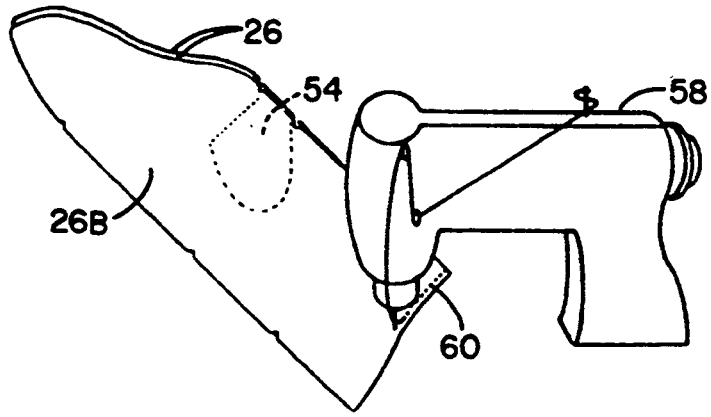
Figure 10:
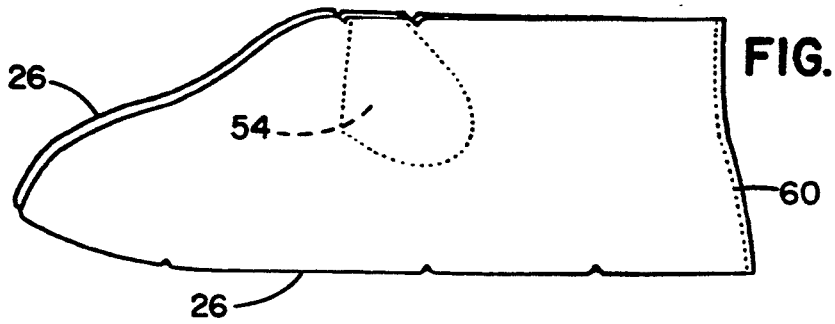
Figure 13:
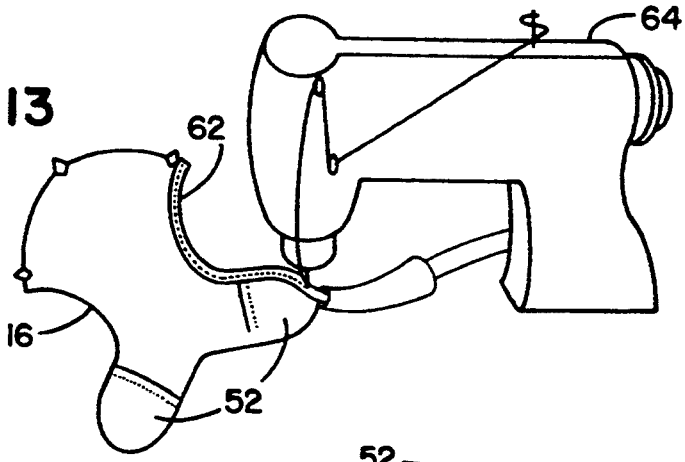
Figure 14:
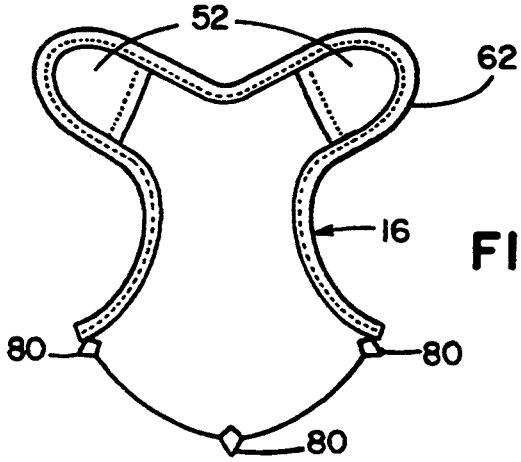
Figure 11:
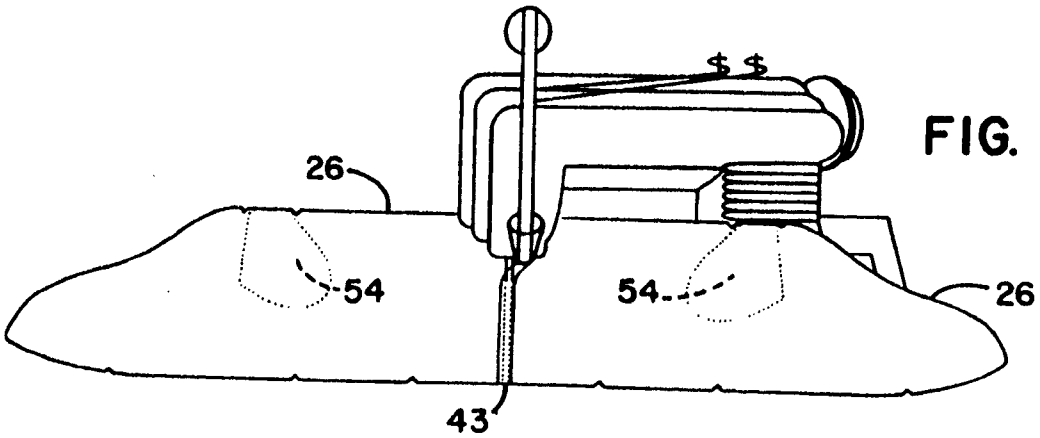
Figure 12:
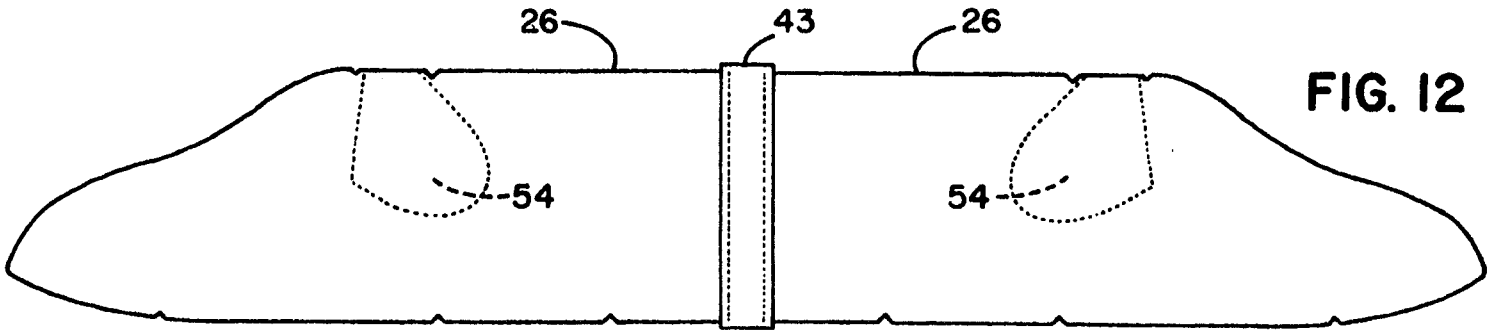

In forming the slipper 10, attention is now directed to FIGS. 4–27. As shown in FIGS. 4 and 5, the flap 16 is constructed by sewing the loop pads 52 to the lining or inside surface 16*a* of flap 16. Preferably, this procedure is done on a standard sewing machine 58. As shown in FIGS. 6–8, the hook tabs 54 are sewn on the exterior surface 26*b* of vamp 26 through use of sewing machine 58. In FIG. 7, the left side vamp is shown. In FIG. 8 the right side vamp is shown. The hook pad 54 is sewn onto the fabric or outside surface of the vamp 26. The pad 54 is sewn to the side of the vamp 26 adjacent end 25, near edge 24. The tabs 52 are sewn onto the tab ends 44,46 of flap 16. After attachment of the pads 54 to vamps 26,26 the vamps 26,26 are sewn together to form an inseam heel as shown in FIGS. 9 and 10. The vamps 26,26 are laid with their inside faces 26*a* opposing one another and are sewn together on the standard sewing machine 58 to form a heel seam 60. The heel tape 43 is applied covering seam 60 as shown in FIGS. 11 and 12.

Figure 15:
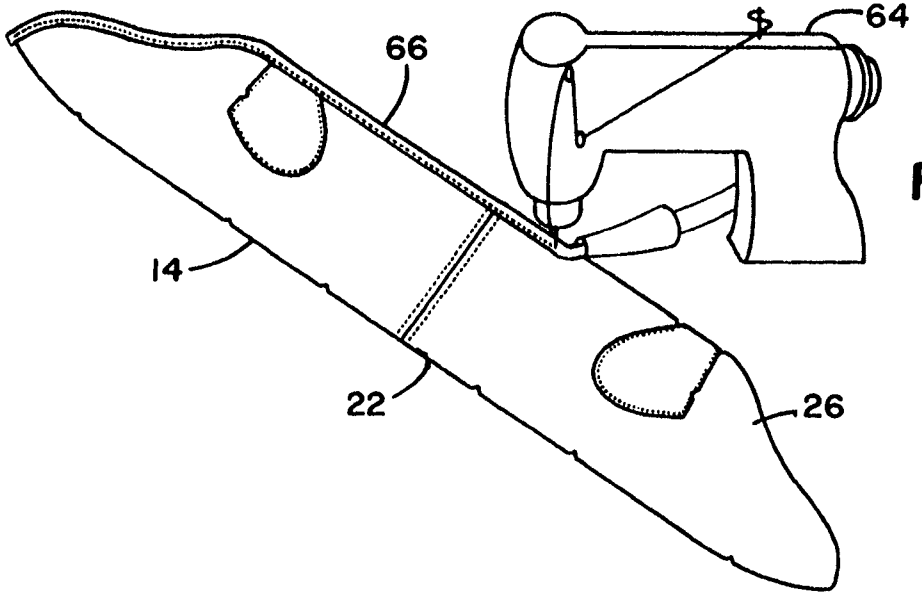
Figure 16:
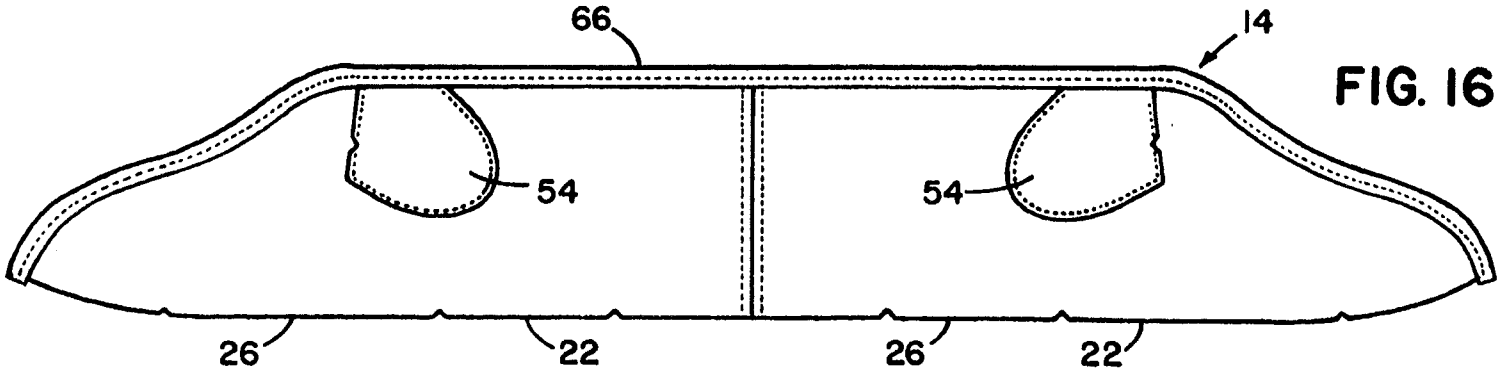

A binding 62 is sewn onto the peripheral edge of the flap 16 to cover all but the toe edge 38. This procedure is formed on a so-called walking foot machine 64 which is well known in the art. Similarly, a binding 66 is applied to all but the lower edges 22 of the upper 14 as shown in FIGS. 15 and 16.

Figure 17:
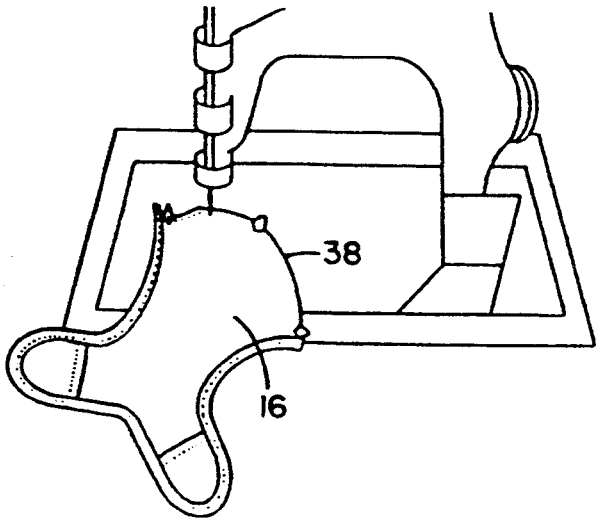
Figure 18:
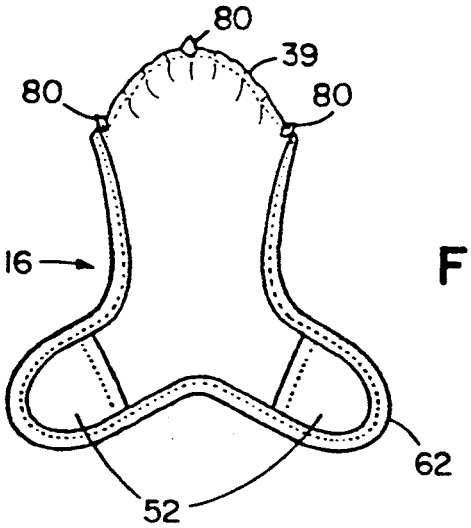

In order to provide adequate volume in the toe area of the shoe 10, the toe edge 38 of flap 16 is shirred on a commercial shirring machine 70 as shown in FIGS. 17 and 18. When completed, the toe edge 38 is bunched or shirred to form a completed shirred edge 39 as shown in FIG. 18.

Figure 19:
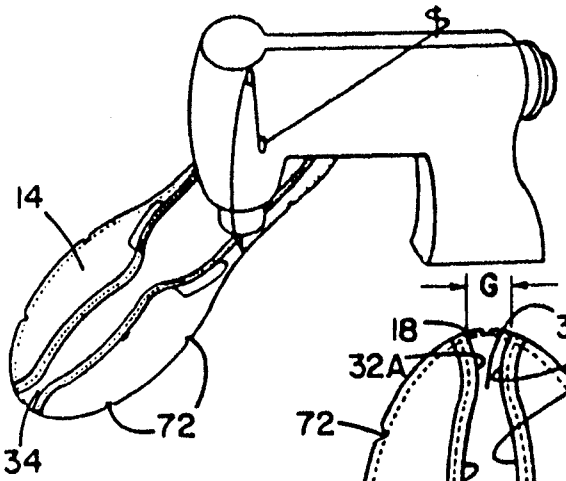
Figure 20:
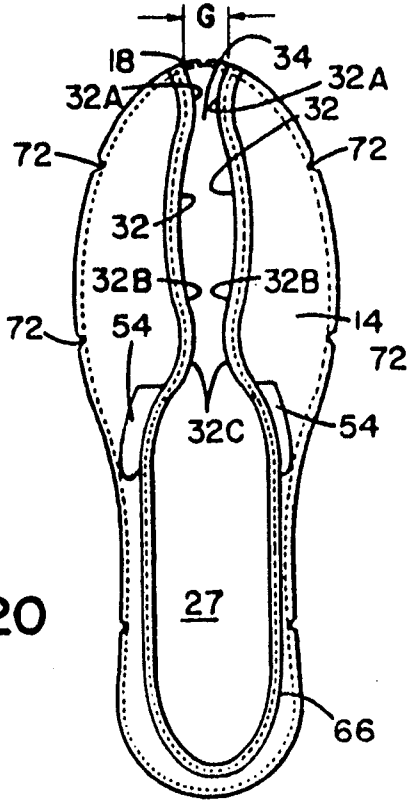

In assembly of the slipper 10, the vamp or upper 14 is stitched to the insole 34 as shown in FIGS. 19 and 20. Notches 72 on both the vamp 14 and the insole 31 ensure proper alignment. As shown best in FIG. 20, forward edges 32 at the toe end are not joined but are spaced apart to provide a gap G. In a preferred embodiment, gap G is about one-half inches and extends entirely from the toe end 18 to the ankle opening 27. The reader will note that edges 32 are contoured such that just rearward of the toe portion 18 the edges come into close proximity at location 32*a* but spread away further from the location 32*a* at location 32*b* and move once more to close proximity at location 32*c*. With this structure as the sections 32*b* or 32*c* are moved closer together, the sections 32*a* move apart and upwardly away from sole 34. This provides greater depth in the toe area and accomplishes the adjustability of the footware.

Figure 21:
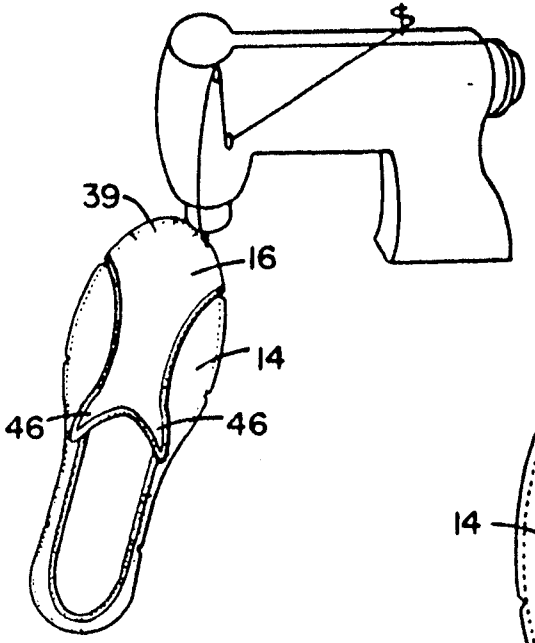
Figure 22:
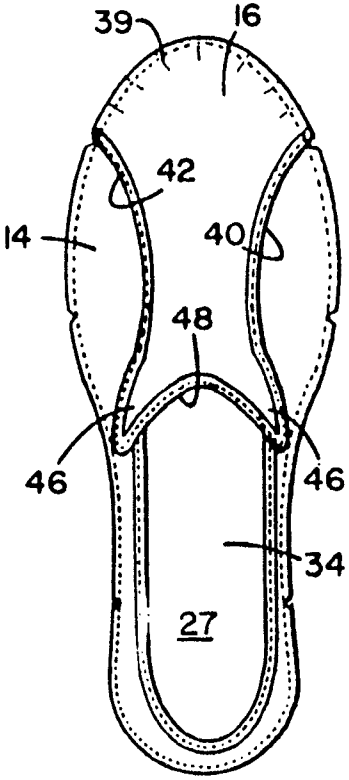

To attach the flap to the shoe 10, the flap 16 is positioned by fastening the Velcro TM loop flaps to the Velcro TM hook flaps on the vamp 14. Alignment tabs 80 are aligned with notches 72 to ensure proper alignment of the toe area. With the flap properly aligned, the toe end is stitched to the insole (as shown in FIGS. 21, 22).

Figures 23, 24, 25:
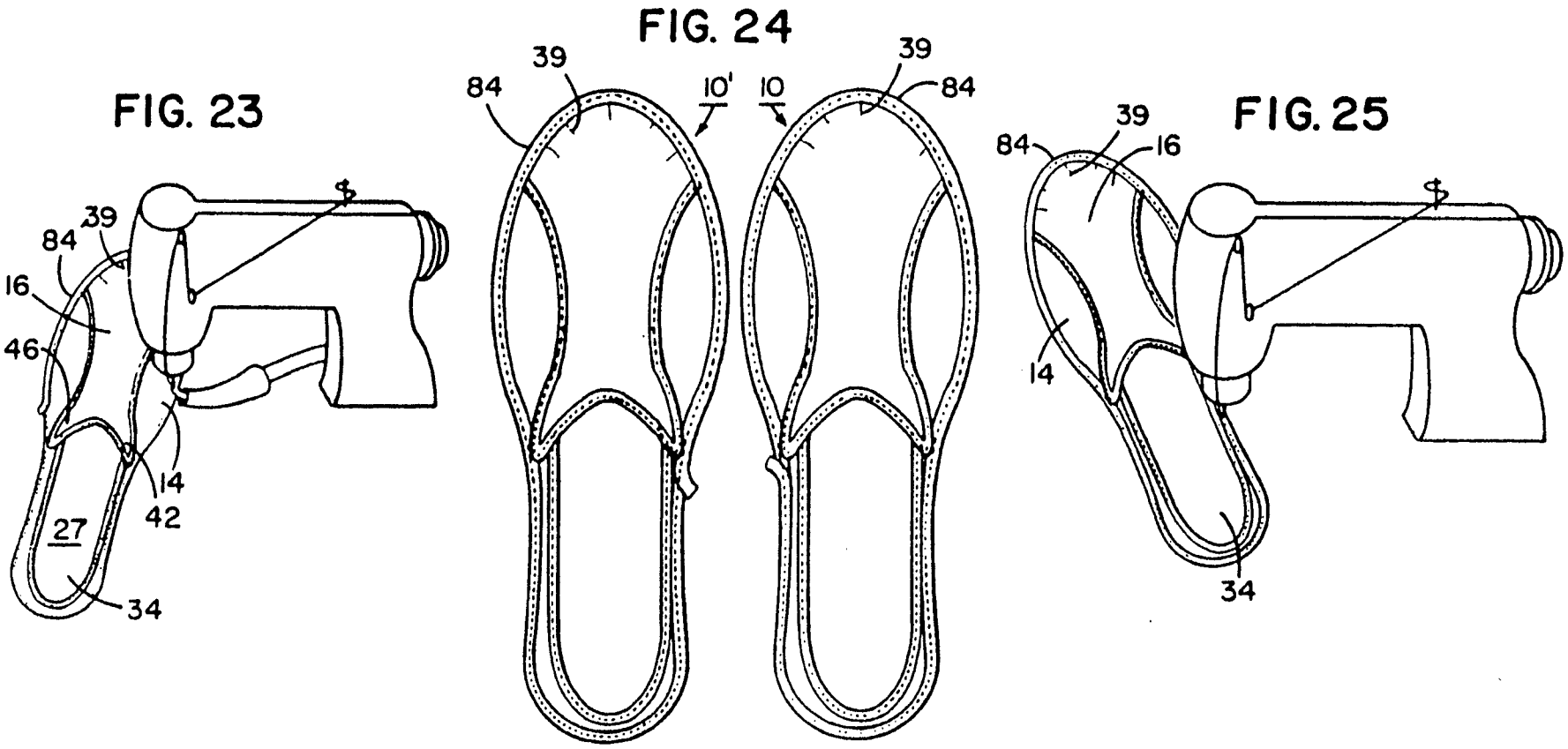
Figure 27:
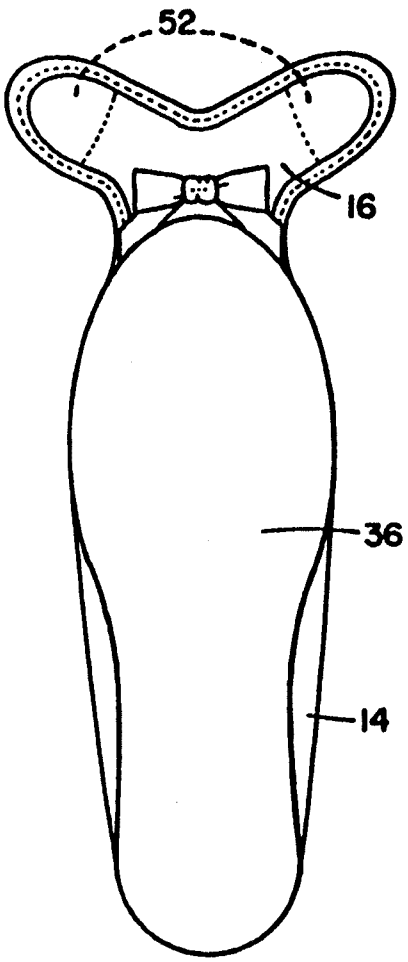
Figure 26:
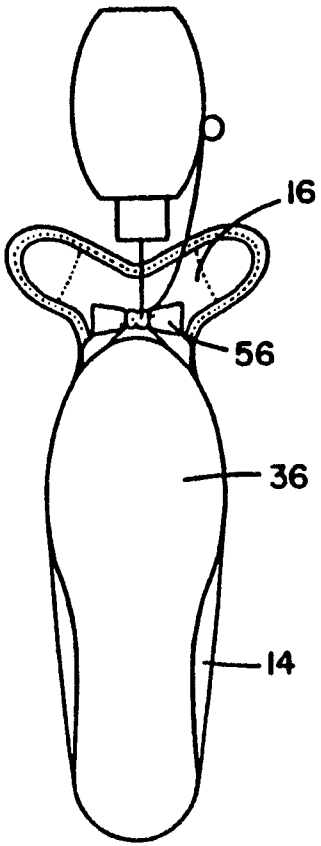

Next, a binding 84 is bound and applied completely around the insole (see FIG. 23) to form a completed slipper with the exclusion of the outsole. The slippers without the outsole are shown in FIG. 24 with both a right slipper 10 and a left slipper 10' shown. As shown, the left 10' and right 10 are identical. Next, the outsole 36 is stitched onto the insole as shown in FIG. 25. With the slipper thus completed, the decorative bow 56 may be tacked onto the flap 16 (see FIGS. 26 and 27).

Having thus described the construction of the slipper, the structure of the completed slipper and its benefits can now be more fully understood. The slipper 10 includes the upper 14 and a flap 16 made of similar fabric which is designed with a shirring 39 at the bottom of the toe portion. The shirring 39 provides a raised elevation in the toe portion which ensures ample room for the toe of deformed feet.

The upper 14 is made of soft, washable fabric. The upper 14 is sewn to the sole around the periphery leaving the open space G at the toe which may be spread apart for maximum adjustment in width. The shaping of the upper forward edge 32 as depicted in FIG. 20 is essential to enabling the slipper to be contoured to the foot of a wearer. The flap 16 has spaced apart sides 40,42 sized for the flap 16 to overlap the upper 14 on each side of the opening G and permits covering of toes but is still open on either side to allow for circulation of air necessary for healing and comfort.

In use, a wearer simply puts the slipper on and adjusts the placement of the flaps 54 that the Velcro TM from the flap 54 engages the Velcro TM pad 52 sewn to the upper 14. The various placements of the flaps 54 provide the adjustments necessary to make it wider or narrower. The wearer determines how much width is necessary for comfort.

The entire slipper is totally washable in hot water to provide sanitary conditions to protect against infection. As illustrated, the slipper has no left and right which facilitates easy on and easy off usage.

The slipper is wide enough to accommodate prosthetic inserts such as corrective orthotics. The slipper provides comfort for feet which are exceptionally swollen but is capable of adjusting to changing needs as swelling diminishes.

From the foregoing detailed description of the present invention, it has been shown how the object of the invention has been attained in the preferred manner. However, modifications and equivalents of the disclosed concepts such as those which would occur to one of ordinary skill in the art, are intended to be included within the scope of this invention.

What is claimed is:

1. An article of footwear comprising:

a sole extending from a toe end to a heel end, said sole terminating at said toe end at a substantially flat sole surface;

an upper having a lower edge secured to said sole, said upper formed of a flexible material shaped to conform to a foot of a wearer, said upper including right and left side portions having right and left, respectively, upper edges with opposing surfaces to define an ankle opening and said upper edges further defining a slot extending from said toe end to said ankle opening, said upper edges curving towards one another, then curving away from one another and then curving towards one another as they extend from said toe end to said ankle opening, thereby enabling said upper to adjustably conform to a foot of a wearer, said right and left side portions terminating at right and left, respectively, forward ends secured to said toe end of said sole at right and left, respectively, points of attachment, said right and left points of attachment spaced apart for said slot to extend from said sole to said ankle opening;

a flap secured to said sole and sized to cover said slot;

adhering means for releasably adhering said flap to said upper; and said flap including a raised end at said toe portion.

2. An article of footwear according to claim 1 wherein said flap is formed of flexible material having a toe edge secured to said sole at said toe portion, said toe edge of said flap is shirred at said toe portion.

3. An article of footwear according to claim 1 wherein said opposing edges of said upper defining said slot may be selectively moved apart to define a slot of varying sizes, said adhering means including means for releasably adhering said flap to said upper for said flap to cover said slot in each adjusted position.

4. An article of footwear according to claim 1 wherein said adhering means includes means for only partially adhering said flap to said upper to provide opposing surfaces of said flap unadhered to opposing surfaces of said upper to accommodate airflow between said upper and said flap.

5. An article of footwear according to claim 1 wherein said upper includes a vamp having a forward edge extending from a toe portion to an ankle portion with said forward edge extending angularly from said toe portion to said ankle portion and contoured to conform to a shape of a wearer.

* * * * *